United States Patent [19]

Ellis et al.

[11] Patent Number: 4,574,977

[45] Date of Patent: Mar. 11, 1986

[54] DRIP TRAY FOR HIGH CHAIRS

[76] Inventors: Kurt Ellis; Debbie K. Ellis, both of 2114 Gale Ave., Long Beach, Calif. 90801

[21] Appl. No.: 463,903

[22] Filed: Feb. 4, 1983

[51] Int. Cl.[4] ..... F16N 31/00

[52] U.S. Cl. ..... 220/403; 220/1 C

[58] Field of Search ..... 220/403, 404, 405, 1 C

[56] References Cited

U.S. PATENT DOCUMENTS

| | | | |
|---|---|---|---|
| 90,036 | 5/1869 | Turner | 108/27 |
| 1,135,269 | 4/1915 | Dudley | 108/271 |
| 1,653,556 | 12/1927 | Faber | 220/404 |
| 1,802,426 | 4/1921 | Hoyt | 220/1 C |
| 2,922,553 | 1/1960 | Wilson, 3rd | 222/572 |
| 3,698,594 | 10/1972 | Bothlert | 220/404 |
| 3,757,990 | 9/1973 | Buth | 220/405 X |
| 3,997,073 | 12/1976 | Morris | 220/1 C |
| 4,484,661 | 11/1984 | Evenson | 220/1 C X |

FOREIGN PATENT DOCUMENTS

| | | | |
|---|---|---|---|
| 1339928 | 12/1973 | United Kingdom | 220/1 C |

*Primary Examiner*—Steven M. Pollard

*Attorney, Agent, or Firm*—I. M. Bak-Boychuk

[57] ABSTRACT

A tray of substantially circular form includes a peripheral edge vertically aligned to contain any liquids that may drop thereon. In this form the tray may be used as a drip pan underneath a high chair to trap any spillage that may be incident in the course of feeding a child. The peripheral edge may include a spout along one surface through which collected liquids may be drained and the tray itself may be lined with a removable towel-like cloth which may be periodically cleaned and dried.

1 Claim, 5 Drawing Figures

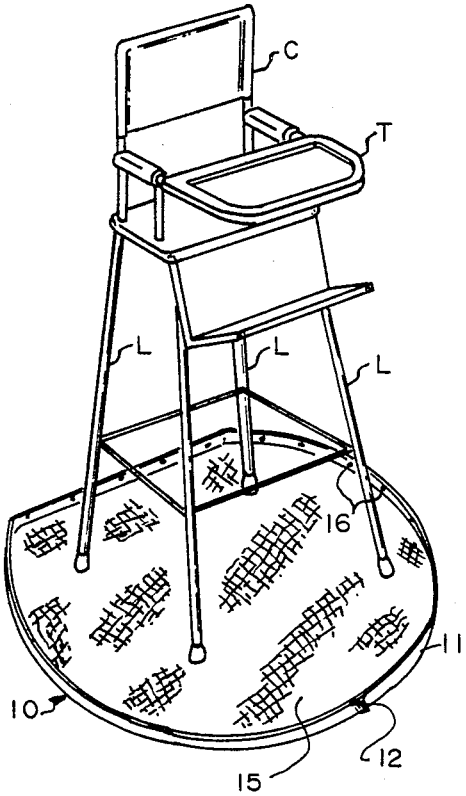
FIG. 1
FIG. 2
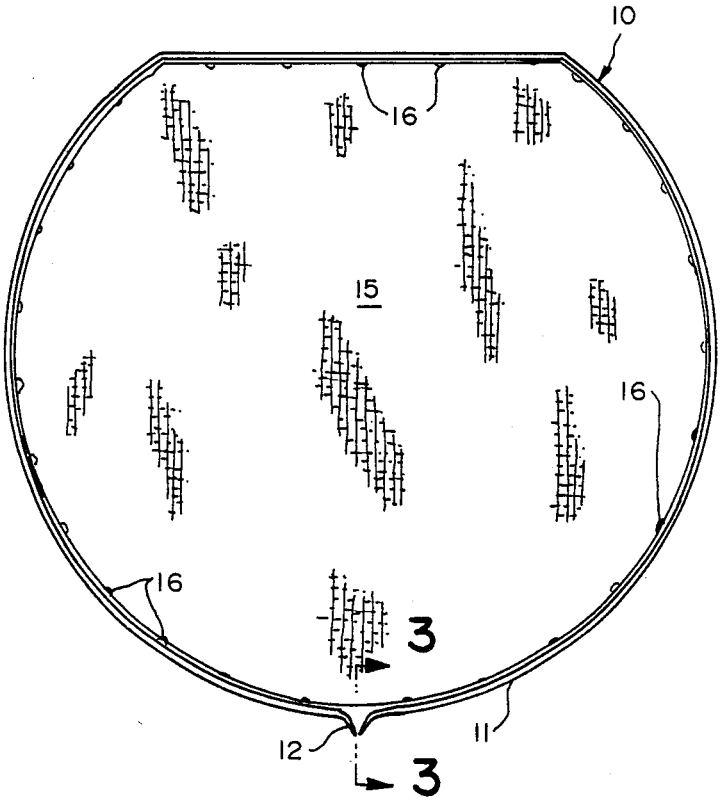
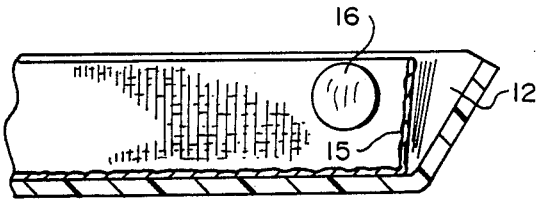
FIG. 3
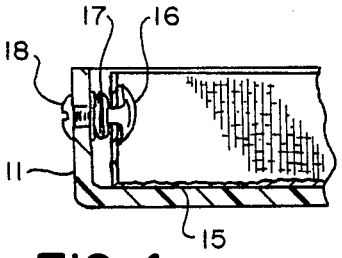
FIG. 4
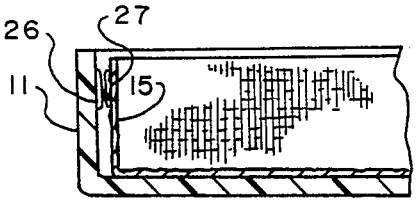
FIG. 5

DRIP TRAY FOR HIGH CHAIRS

BACKGROUND OF THE INVENTION

1. Field of the Invention

The present invention relates to trays and other liquid containing devices, and particularly to trays useful with high chairs.

2. Description of the Prior Art

The course of feeding a child is known to be frequently accompanied with liquid spillage which in the normal household entails the soiling of various floor coverings and an elaborate clean-up process. For this reason the high chair as it is presently constructed frequently includes a tray on the upper surface thereof onto which food utensils are placed and from which the child is fed. These trays on the upper end of a high chair are often insufficient in their capacity to retain liquid spillage and invariably liquids escape onto the floor. Heretofore it has been the typical practice to spread a towel or similar absorbing cloth underneath the high chair and it is this cloth that has served the function of collecting the incidental spillage. Quite often, however, the amount of spillage in any one feeding exceeds the wick capabity of this towel and some fluid invariably escapes onto the floor.

It is this exact problem that is addressed herein and it is for this problem that the present invention provides a solution.

SUMMARY OF THE INVENTION

Accordingly, it is the general purpose and object of the present invention to provide a tray for use underneath a high chair which is generally shaped to the pattern of normal spillage and which includes cloth-like layers on the interior thereof for absorbing fluid.

Other objects of the invention are to provide a tray for use subjacent a high chair which includes a removable towel-like liner.

Yet further objects of the invention are to provide a tray for containing liquids spilled from a child's chair which includes layers of cloth thereon.

Briefly, these and other objects are accomplished within the present invention by providing a tray generally conformed as a drip pan and having a plan form of a circle to approximate the normal spillage patterns from a high chair. The peripheral edge of this tray extends upwardly to contain any liquids dropped thereon and the edge may be further convolved to include a spout or a nozzle through which collected liquids can be drained. The peripheral edge, furthermore, may be provided with various fasteners for securing a cloth liner and it is this liner that will contain most of the liquids dropped thereon. Furthermore, this liner may serve the function of collecting the dropped solid debris and in the course of this collection to soak up any attendant moisture.

To render the foregoing assembly more convenient in its use, the liner may be attached to the peripheral edge by a plurality of fasteners and may be removed for periodic cleaning. In one preferred embodiment these fasteners may take the form of snap fasteners attached by bolts extending through the peripheral edge or which may engage corresponding fittings formed in the periphery of the cloth liner. Alternatively, the interior surface of the peripheral edge may be provided with strips of Velcro which will engage corresponding strips on the periphery of the liner. In this form the assembly may be placed underneath the high chair and as the liner becomes soiled periodic cleaning can be made.

BRIEF DESCRIPTION OF THE DRAWINGS

FIG. 1 is a perspective illustration of a high chair supported on a drip pan constructed according to the present invention;

FIG. 2 is a plan form of the drip tray shown in FIG. 1;

FIG. 3 is a sectional view, in detail, taken along line 3—3 of FIG. 2;

FIG. 4 is yet another sectional view, in detail, taken along line 4—4 of FIG. 2; and FIG. 5 is yet another detail view, in section, illustrating an alternative mode of attaching the liner within the interior of the inventive drip tray.

DESCRIPTION OF THE PREFERRED EMBODIMENTS

As shown in FIGS. 1–4 a conventional high chair C normally includes a plurality of support legs L extending from the seat on which the child is place. At the same time the seat structure is provided with an elevated tray T from which feeding normally occurs. In this form the child normally has a preferred orientation in its alignment on the chair and the incidents of items dropped from the elevated tray T will normally be within a circular area encompassing the front of the chair.

For this reason an inventive tray, generally designated by the numeral 10, is generally formed as a segment of a circle, having one linear edge for convenience in aligning the tray against any wall within a household. The tray 10 includes a peripheral edge 11 to form a bounded volume in which any liquids will be retained. At any convenient point in the peripheral edge a spout 12 may be formed for draining these collected liquids and the tray itself may be lined with a cloth liner 15. This liner 15 is generally conformed to match the shape of the tray 10 having somewhat of an excess in its dimensions to allow for the curling of its periphery along the interior surface of the peripheral edge 11. In this form the liner 15 may be provided with a plurality of snaps 16 which are spread along the edge at dimensions corresponding to a plurality of fasteners 17 formed in the peripheral edge. More specifically, each of the fasteners 17 is of the bolted configuration and includes a screw or a bold 18 extending through the peripheral edge 11. Since the disposition of each of the fasteners 17 is in the vertical surface of the peripheral edge 11 the volume of water contained within the drip pan will normally not leak out through this connection.

In the alternative the periphery of liner 15 may be provided with a plurality of segments of Velcro 26 which are aligned to engage corresponding strips of Velcro 27 on the interior surface of edge 11. This alternative implementation is shown in FIG. 5.

In either form the liner 15 is removably attached within the interior of the tray 10 and can therefore be periodically cleaned or dried. Should any liquids in excess of the wick capacity of the liner 15 be deposited into the tray this excess may be spilled into any convenient receptacle through the spout 12. The liner 15 may furthermore be of any conventional cloth structure, the preferred structure being of the configuration of a towel to provide maximum wick storage capacity.

Obviously many modifications and changes may be made to the foregoing description without departing from the spirit of the invention. It is therefore intended that the scope of the invention be determined solely on the claims appended hereto.

What is claimed is:

1. A drip tray assembly adapted for use subjacent a high chair comprising:

a substantially circular, plastic pan of a plan form conformed to receive the legs of said chair having a vertical peripheral edge thereabout for containing any liquids deposited thereon, said peripheral edge including a plurality of attachment means deployed on the interior surface thereof, a spout for draining of liquids and a straight segment for alignment relative a wall;

a cloth liner of towel-like wick characteristics conformed for receipt on the interior of said pan and including a plurality of engaging means aligned on the periphery thereof for releasable engagement with said attachment means, whereby any moisture dropped into said pan is absorbed in said liner for convenient removal thereof.

* * * * *